US005878965A

United States Patent [19]

Coldren et al.

[11] Patent Number: 5,878,965

[45] Date of Patent: Mar. 9, 1999

[54] INTERNALLY WETTED CARTRIDGE CONTROL VALVE FOR A FUEL INJECTOR

[75] Inventors: Dana R. Coldren, Fairbury, Ill.; Charles D. Ellenbecker, Manhattan, Kans.; Ching W. Jaw, Phoenix, Ariz.

[73] Assignee: Caterpillar Inc., Peoria, Ill.

[21] Appl. No.: 919,683

[22] Filed: Aug. 28, 1997

[51] Int. Cl.[6] ..... B05B 1/30; F02M 51/00

[52] U.S. Cl. ..... 239/585.1; 239/88; 239/90; 239/91; 239/533.3; 239/533.9; 239/585.2; 251/50; 251/52; 251/129.02; 251/129.07; 251/129.16

[58] Field of Search ..... 239/88, 90, 91, 239/533.1, 533.2, 533.3, 533.9, 533.12, 585.1, 585.2, 585.3; 251/50, 52, 129.02, 129.07, 129.16

[56] References Cited

U.S. PATENT DOCUMENTS

| | | | |
|---|---|---|---|
| 3,446,474 | 5/1969 | Diver | 251/141 |
| 4,646,976 | 3/1987 | Rembold et al. | 239/585.1 |
| 4,717,118 | 1/1988 | Potter | 251/129.02 |
| 4,869,462 | 9/1989 | Logie et al. | 251/129.16 |
| 5,118,076 | 6/1992 | Homes | 251/129.02 |
| 5,121,730 | 6/1992 | Ausman et al. | 123/467 |
| 5,241,935 | 9/1993 | Beck et al. | 123/300 |
| 5,341,783 | 8/1994 | Beck et al. | 123/446 |
| 5,375,576 | 12/1994 | Ausman et al. | 123/446 |
| 5,407,131 | 4/1995 | Maley et al. | 239/90 |
| 5,494,219 | 2/1996 | Maley et al. | 239/88 |
| 5,605,289 | 2/1997 | Maley et al. | 239/585.1 |

*Primary Examiner*—Andres Kashnikow
*Assistant Examiner*—Robin O. Evans
*Attorney, Agent, or Firm*—Michael McNeil

[57] ABSTRACT

A control valve, preferably for use with a fuel injector, includes a valve body defining a solenoid cavity, an inlet passage, an outlet passage and a metering passage extending between the solenoid cavity and the outlet passage. A solenoid is mounted in the solenoid cavity. A valve member has one end attached to the solenoid and is positioned to reciprocate in the valve body between an open position in which the inlet passage is opened to the outlet passage and a closed position in which the inlet passage is closed to the outlet passage. The inlet passage is in fluid communication with the solenoid cavity via the metering passage when the valve member is in its open position. Appropriate sizing of the metering passage can prevent secondary injections by providing adequate pressure relief to the solenoid cavity while also substantially damping any pressure waves that may travel to the solenoid cavity through the metering passage.

20 Claims, 8 Drawing Sheets

METERING CLEARANCE TOO SMALL
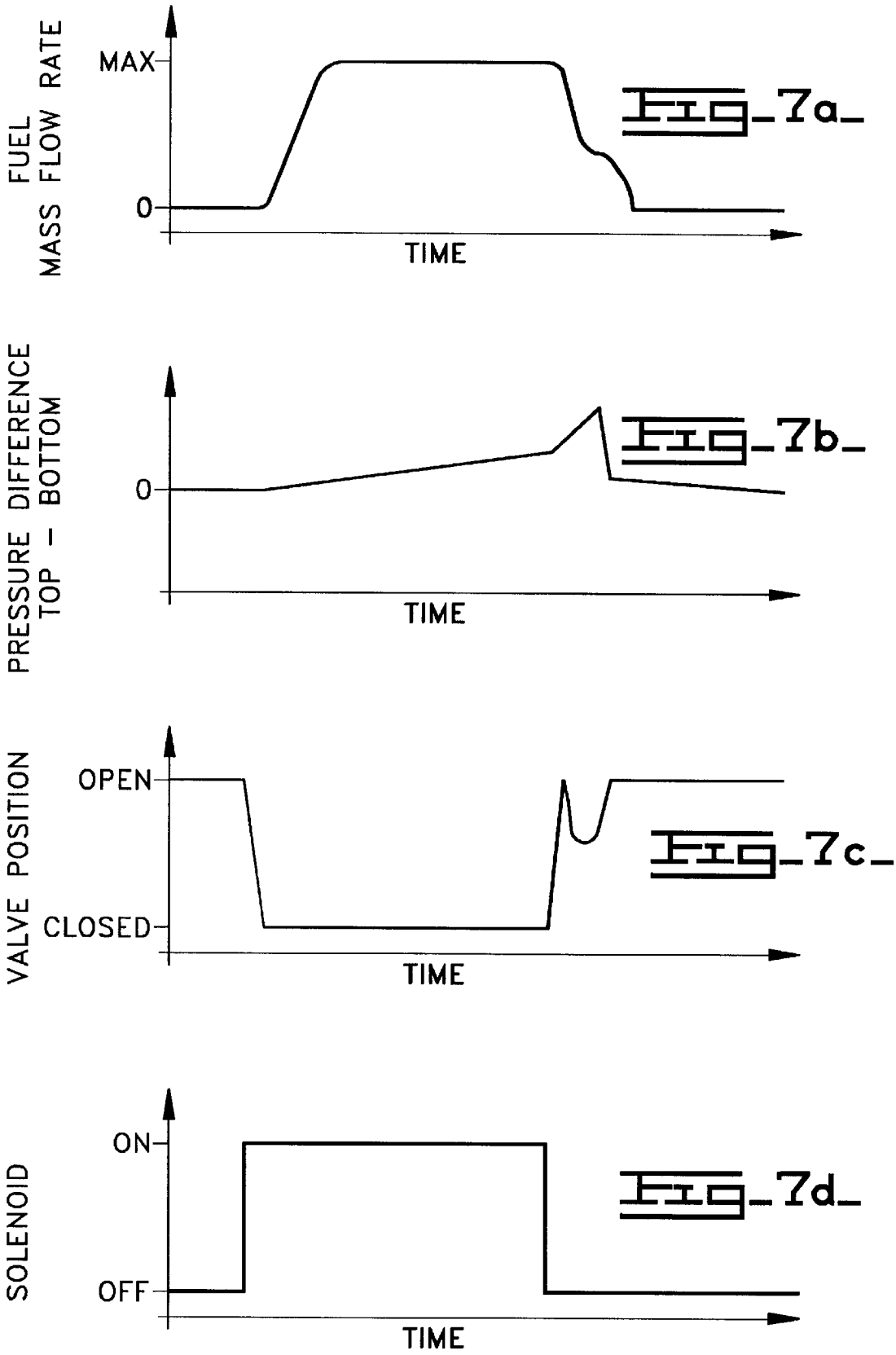

METERING CLEARANCE JUST RIGHT
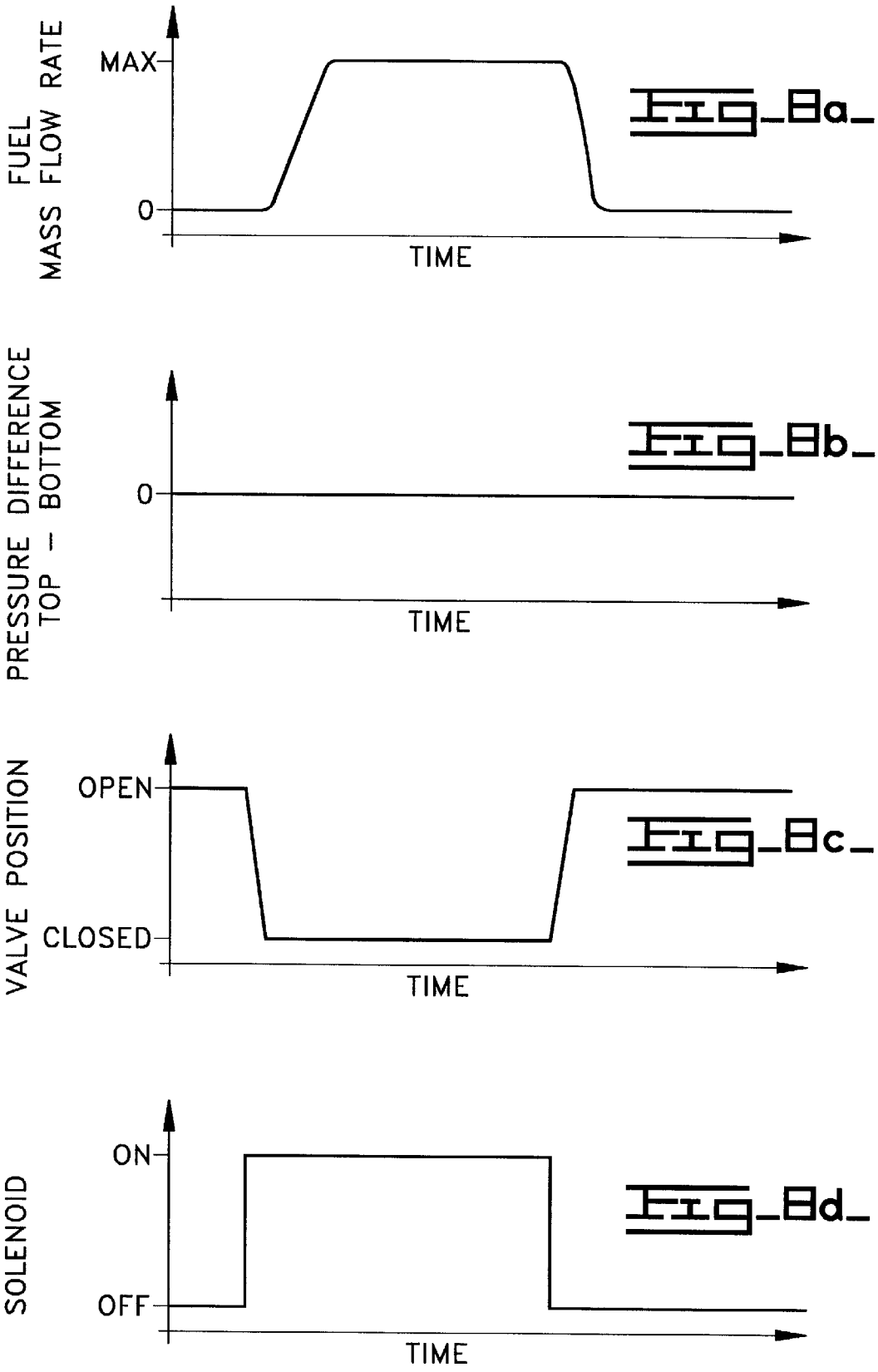

METERING CLEARANCE TOO LARGE

INTERNALLY WETTED CARTRIDGE CONTROL VALVE FOR A FUEL INJECTOR

TECHNICAL FIELD

The present invention relates generally to electronically controlled fuel injectors, and more particularly to internally wetted cartridge control valves therefore.

BACKGROUND ART

Examples of electronically controlled cartridge control valves for fuel injectors are shown in U.S. Pat. No. 5,494,219 to Maley et al., U.S. Pat. No. 5,407,131 to Maley et al., U.S. Pat. No. 4,869,462 to Logie et al., and U.S. Pat. No. 4,717,118 to Potter. In each of these examples, the injector includes a mechanically actuated fuel pumping plunger and an electronically actuated fuel pressure control valve assembly. The pressure control valve assembly includes a solenoid operated poppet valve that controls fuel pressure in the injector in order to control fuel injection delivery. Fuel pressure is controllably enabled to be developed within the injector by electrical actuation of the pressure control valve assembly. Fuel pressure is controllably prevented from developing within the injector by not electrically actuating the pressure control valve so that fuel can spill through a return passage while the plunger is undergoing a portion of its pumping stroke.

In such electronically controlled fuel injectors, the armature of the pressure control valve assembly moves the poppet valve in one direction until it engages a valve seat, and holds the poppet valve in its closed position to enable fuel pressure to be developed in the injector, eventually resulting in fuel injection. At the end of the fuel injection cycle, the solenoid is de-energized, and a return spring moves the poppet valve member off the valve seat, returning the poppet valve member to its open position, which prevents the development of fuel pressure by spilling the fuel back to a fuel reservoir.

In most of these type of valve assemblies, the valve body holding the solenoid is sealed against leakage of fuel out of the control valve. While fuel leakage out of the control valve can be accomplished in a number of ways known in the art, such as by using closed housings or appropriately positioned o-rings and the like, accommodating internal leakage within the cartridge control valve has proven somewhat more problematic. For instance, the slow build up of fuel pressure in the cavity containing the solenoid due to leakage between the poppet valve member and its guide bore can sometimes result in undesirable bouncing behavior on the part of the poppet valve member. Because this bouncing phenomenon can sometimes result in undesirable secondary injections, some means must be provided for relieving fuel pressure from the cavity containing the solenoid.

It has been observed that if a pressure relief passage from the cavity containing the solenoid is too small, undesirable secondary injections can still occur since adequate pressure relief cannot occur through a restricted pressure relief passage when the poppet valve member is moving from its closed to its open position. On the other hand, it has been observed that if the pressure relief passage is too large, pressure spikes can travel up through the pressure relief passage, into the cavity containing the solenoid and act upon one end of the poppet valve member causing the poppet valve member to briefly close, which again can cause undesirable secondary injections. It is well known in that art that abruptly ending each injection event and avoiding secondary injections can significantly improve hydrocarbon and particulate emissions.

The present invention is directed to overcoming one or more of the problems as set forth above.

DISCLOSURE OF THE INVENTION

In one embodiment, a control valve includes a valve body defining a solenoid cavity, an inlet passage, an outlet passage and a metering passage extending between the solenoid cavity and the outlet passage. A solenoid is mounted in the solenoid cavity. A valve member with one end attached to the solenoid is positioned to reciprocate in the valve body between an open position in which the inlet passage is open to the outlet passage, and a closed position in which the inlet passage is closed to the outlet passage. The inlet passage is in fluid communication with the solenoid cavity via the metering passage when the valve member is in its open position.

In another embodiment of the present invention, a portion of the metering passage includes a diametrical clearance area between a bore defined by the valve body and a portion of the valve member. The metering passage is sufficiently large that the valve member is substantially prevented from bouncing toward its closed position after being moved to its open position, but is sufficiently small that a fluid pressure spike traveling toward the solenoid cavity through the metering passage is substantially damped before reaching the solenoid cavity.

In still another embodiment of the present invention, a fuel injector includes an injector body defining a fuel inlet, a nozzle outlet and a cartridge opening. The injector body further defines a spill passage and a return passage that open into the cartridge opening. A cartridge control valve is received in the cartridge opening and attached to the injector body. The cartridge control valve includes a valve body defining a solenoid cavity, an inlet passage that opens to the spill passage, an outlet passage that opens to the return passage, and a metering passage extending between the solenoid cavity and the outlet passage. A solenoid is mounted in the solenoid cavity. A valve member with one end attached to the solenoid is positioned to reciprocate in the valve body between an open position in which the inlet passage is open to the outlet passage and a closed position in which the outlet passage is closed to the inlet passage. The inlet passage is in fluid communication with the solenoid cavity via the metering passage when the valve member is in its open position.

BRIEF DESCRIPTION OF THE DRAWINGS

FIGS. 7*a–d* are graphs of fuel injection mass flow, poppet valve pressure differential, valve position and solenoid status, respectively, versus time for a single injection event when the metering passage is too small.

FIGS. 8*a–d* are graphs of fuel injection mass flow, poppet valve pressure differential, valve position and solenoid status, respectively, versus time for a single injection event when the metering passage has a flow area according to the present invention.

BEST MODE FOR CARRYING OUT THE INVENTION

Figure 1:
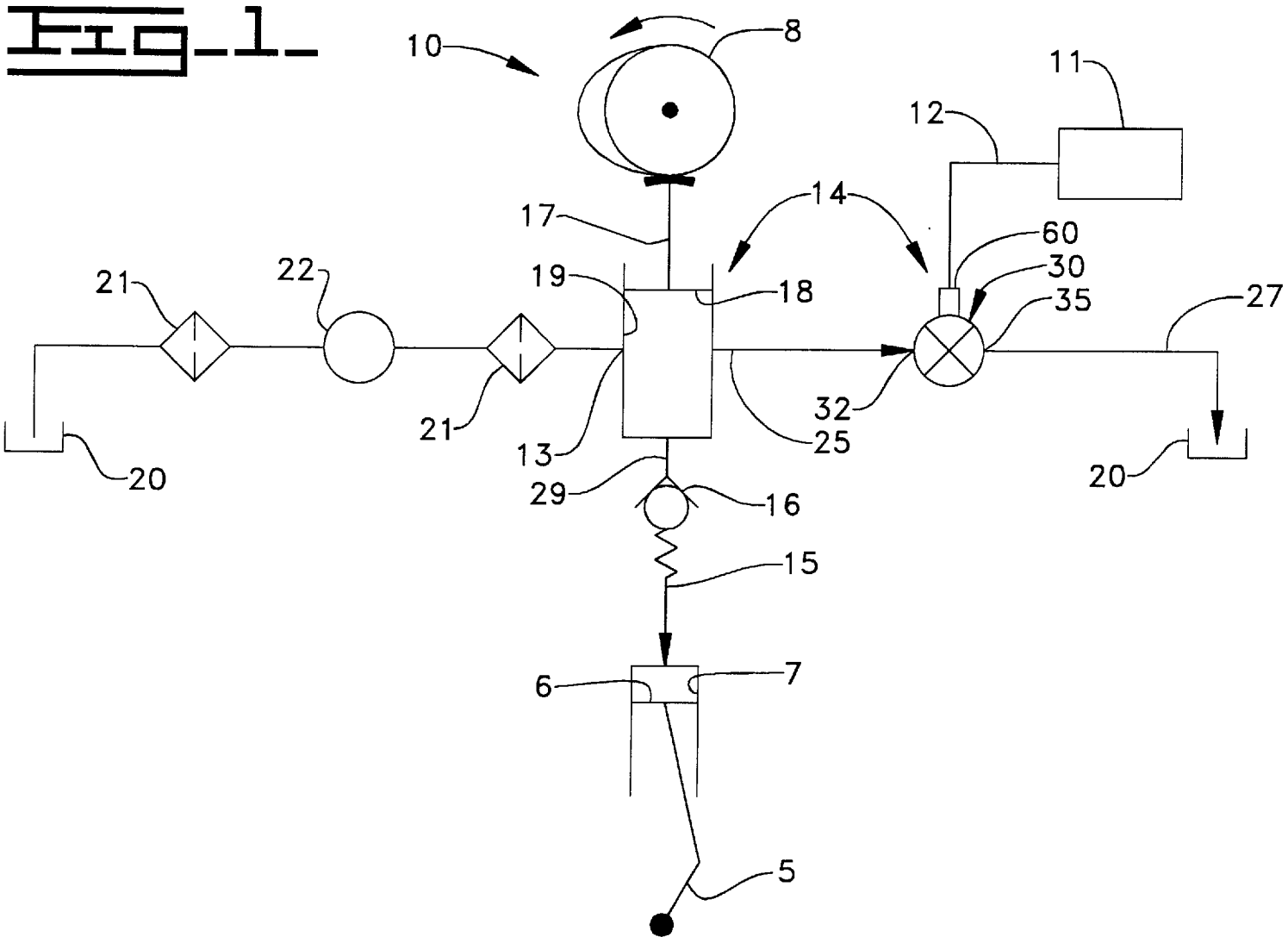
FIG. 1 is a schematic diagram illustrating a mechanically actuated electronically controlled fuel injection system.

In the drawings, the same reference numerals designate the same elements for features throughout all of the drawings.

Referring now to FIG. 1, there is illustrated an injector fuel system 10 adapted for a diesel-cycle direct-injection internal combustion engine having a number of engine pistons, only one of which is shown, i.e. piston 6. Each engine piston and corresponding engine cylinder would have a different fuel injector 14. Each engine piston 6 reciprocates in a separate cylinder 7 due to rotation of the engine drive shaft 5 in a conventional manner. Drive shaft 5 also rotates cam 8 which acts upon a tappet 17 of each injector 14 to mechanically actuate the injectors with each revolution of the engine.

Fuel injection system 10 includes a fuel source or tank 20. Fuel is drawn from fuel tank 20 by a relatively low pressure transfer pump 22, which carries the fuel through one or more fuel filters 21 to the fuel inlet 13 of each injector 14. With each revolution of cam 8, tappet 17 drives a pump piston 18 downward in pump chamber 19. Pump chamber 19 is connected to a spill passage 25 and a nozzle chamber 29 within injector 14. When fuel pressure within pumping chamber 19 is above a valve opening pressure, needle check valve 16 opens and fuel commences to spray into cylinder 7 through nozzle outlet 15. The fuel is prevented from reaching the valve opening pressure as long as spill passage 25 is open.

Spill passage 25 is connected to an inlet passage 32 of cartridge control valve 30. An outlet passage 35 from cartridge control valve 30 is connected to a return passage 27, which in turn is connected back to fuel tank 20 for recirculation. Fuel injection is controlled by opening and closing cartridge control valve 30 to open and close fluid communication between inlet passage 32 and outlet passage 35. This opening and closing of cartridge control valve 30 is controlled by a conventional electronic control module 11 that commands the energization or de-energization of a solenoid 60 via a communication line 12 in a conventional manner.

Figures 2, 4:
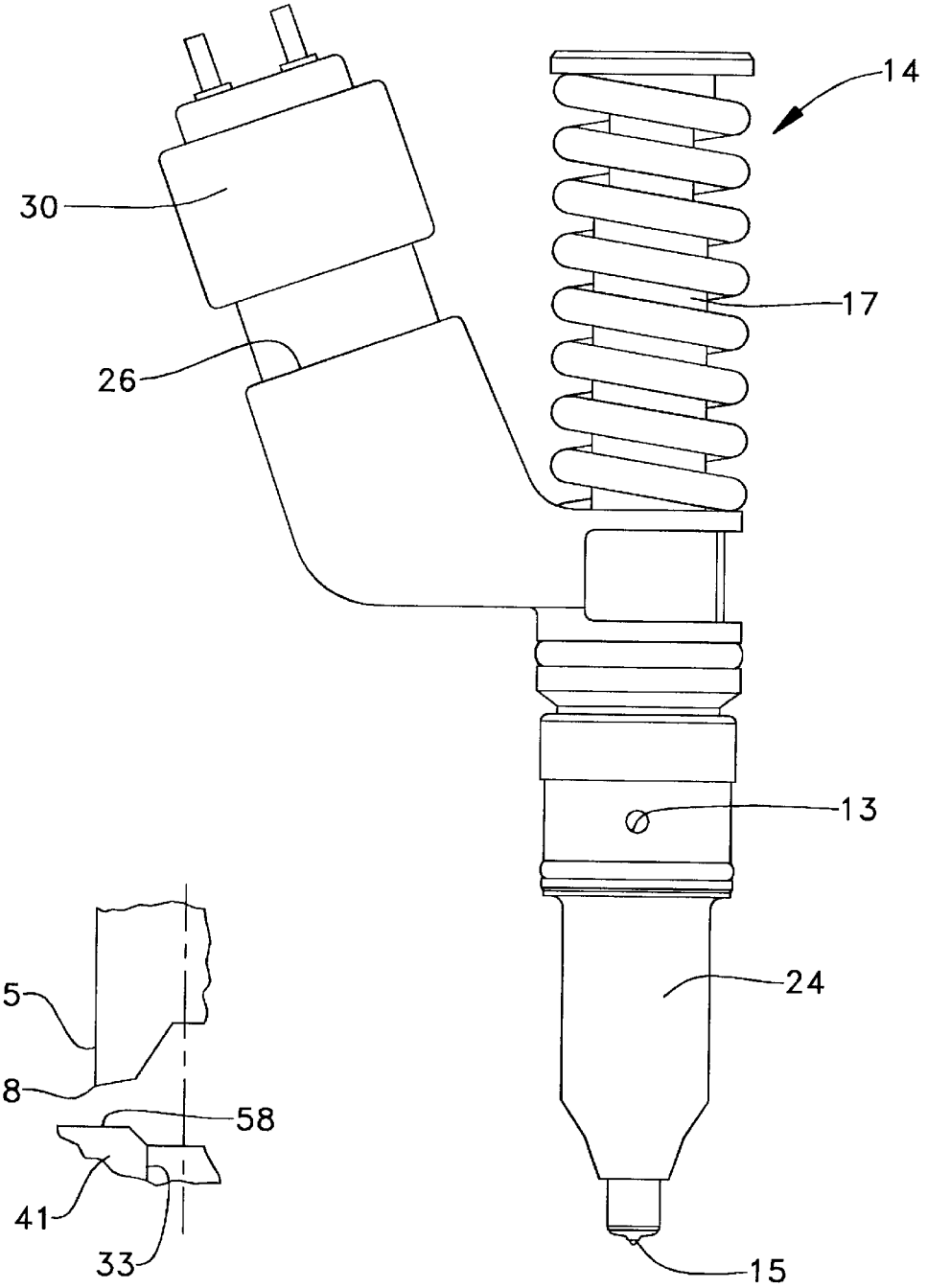
FIG. 2 is an elevational view of a fuel injector incorporating a cartridge control valve according to one embodiment of the present invention.
FIG. 4 is a fragmented sectional view illustrating a flat seat and concave end with knife edge valve member in accordance with one aspect of the present invention.

Referring now to FIG. 2, an example injector 14 according to the present invention is illustrated. Fuel injector 14 includes an injector body 24, a fuel inlet 13, a nozzle outlet 15 and a cartridge opening 26 formed in injector body 24. A cartridge control valve 30 is received in cartridge opening 26 and attached to injector body 24.

Figure 3:
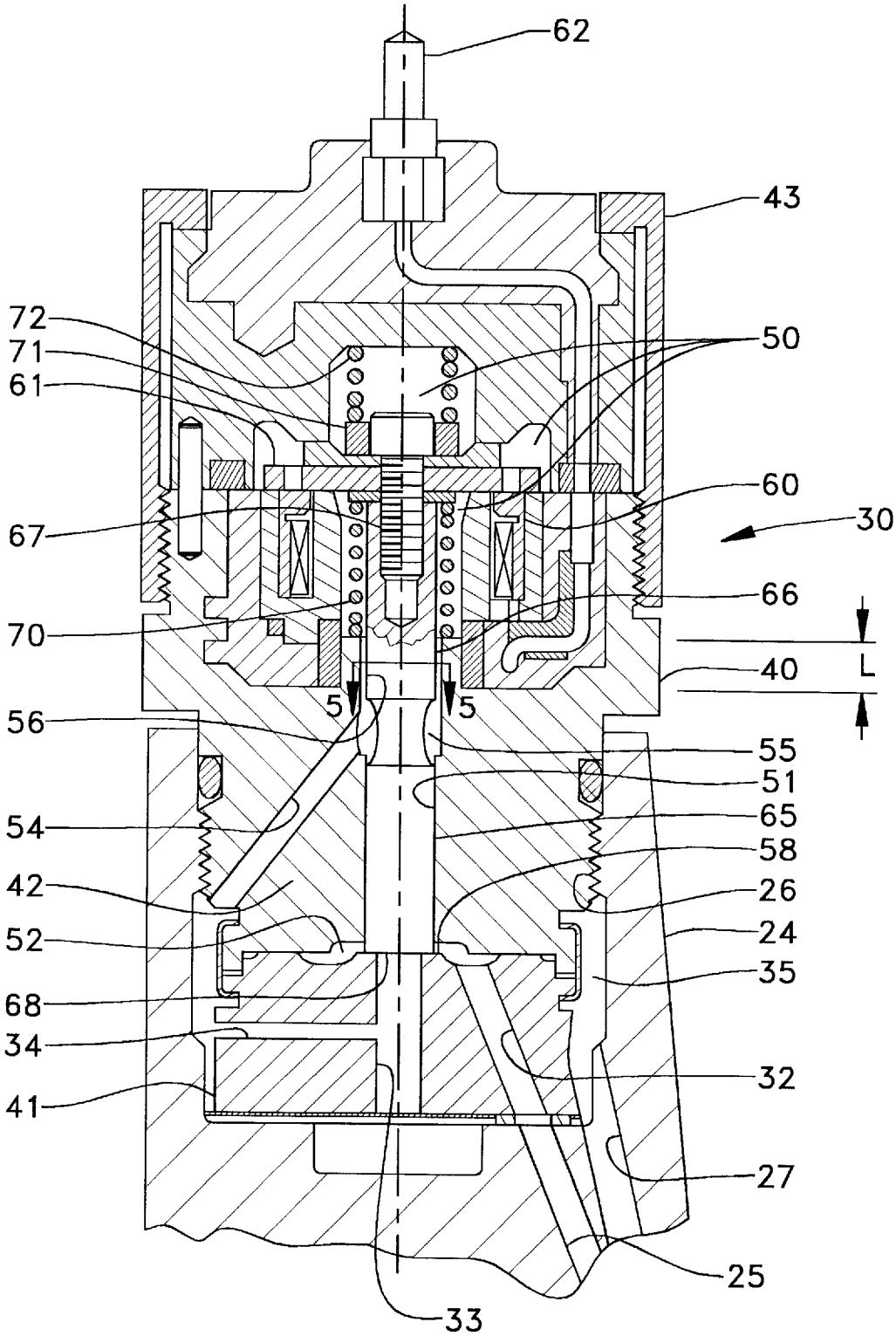
FIG. 3 is a partially sectioned side elevational view of a cartridge control valve according to the present invention.

Referring now to FIG. 3, the inner structure of cartridge control valve 30 is illustrated. Cartridge control valve 30 includes a valve body made up of a plurality of cylindrically shaped body components 40, 41 and 43 that are attached to one another in a manner well known in the art. When cartridge control valve 30 is attached to injector body 24, its inlet passage 32 is connected to a spill passage 25, which is connected to the pump chamber within the injector as discussed earlier. Also, an annular outlet passage 35 is connected to a return passage 27. A poppet valve member 65 is mounted within the valve body and reciprocates between an open position in which annular outlet passage 35 is open to inlet passage 32 via a vertical outlet passage 33 and a plurality of horizontal outlet passages 34, only one of which is shown. Poppet valve member 65 can also be moved to a closed position in which inlet passage 32 is closed to annular outlet passage 35.

The various body components of cartridge control valve 30 are preferably attached to one another in a way that seals against leakage of fuel out of cartridge control valve 30. The valve body defines a solenoid cavity 50 within which is mounted a solenoid 60. Poppet valve member 65 is attached to armature 61 of solenoid 60 via a conventional screw 67. A metering passage 54 extends between solenoid cavity 50 and annular outlet passage 35 so that solenoid cavity 50 is wetted but is sealed against leakage to the outside of cartridge control valve 30 in a conventional manner. In this embodiment, a portion of metering passage 54 includes a diametrical clearance area 56, with a length L, that is located between a portion 66 of poppet valve member 65 and an enlarged diameter portion 56 of guide bore 51.

A return spring 70 normally biases poppet valve member 65 upward to its open position. The upward force of return spring 70 is trimmed during manufacture of cartridge control valve 30 through the use of a relatively weak trimming spring 72 and trimming spacer 71 in a conventional manner.

Referring now also to FIG. 4, valve body component 41 is machined to include a relatively flat annular seating surface 58 that defines a portion of a spill cavity 52 defined by the joinder of valve body components 41 and 42. One end 68 of poppet valve member 65 is machined to include an annular knife edge 67 that closes spill cavity 52 to vertical passage 33 when seated against flat seating surface 58. Thus, return spring 70 normally biases annular knife edge 67 away from flat seating surface 58 as shown in FIG. 4; however, when solenoid 60 is energized, poppet valve member 65 is pulled downward to seat annular knife edge 67 against flat seating surface 58 to close fluid communication between inlet passage 32 and annular outlet passage 35. Poppet valve member 65 is preferably hydraulically balanced by having a first hydraulic surface area exposed to fluid pressure in solenoid cavity 50 that is about equal to a second hydraulic surface area (end 68) that is exposed to fluid pressure in vertical outlet passage 33. Thus, except for fluid pressure gradients existing between solenoid cavity 50 and vertical outlet passage 33, the only forces acting on poppet valve member 65 should originate from solenoid 60, return spring 70 and trimming spring 71.

Although the high fuel pressures existing in inlet passage 32 and spill cavity 52 during an injection event will inevitably cause a small amount of fuel to leak along the outer surface of poppet valve member 65 along guide bore 51, solenoid cavity 50 is substantially isolated from inlet passage 32 when poppet valve member 65 is in its closed position. However, when poppet valve member 65 is in its open position, solenoid cavity 50 is in fluid communication with inlet passage 32 via spill cavity 52, vertical spill passage 33, horizontal spill passages 34, outlet passages 35 and most importantly metering passage 54. The use of a wetted solenoid cavity 52 permits the fuel within this area to damp the movement of poppet valve 65 so that it does not bounce back toward its closed position upon contacting its back stop at its open position. Metering passage 54 also serves to relieve any excess fluid pressure in solenoid cavity 50 so that poppet valve member 65 remains hydraulically balanced.

While it is preferable to maintain poppet valve member 65 hydraulically balanced, engineers have noted that a hydraulic imbalance can be created due to dynamic flow conditions existing when the relatively low pressure area in vertical outlet passage 33 is opened to the relatively high pressure existing in spill cavity 52 when poppet valve member 65 moves off its seat from its closed position toward its open position at the end of an injection event. In other words, when poppet valve 65 moves from its closed position to its open position, fluid pressure spikes and/or expansion waves can be created. Because solenoid cavity 50 is in fluid communication with annular outlet passage 35 via metering passage 54, these pressure spikes can travel up into solenoid cavity 50. Under the right conditions, the presence of an expansion wave in vertical chamber 33 and/or the presence of a pressure spike in solenoid cavity 50 can create a temporary hydraulic imbalance in poppet valve member 65, sometimes causing it to move toward its closed position when it should be open. The movement of poppet valve member 65 toward its closed position during these dynamic flow conditions can cause an undesirable secondary injection.

Undesirable secondary injections can also occur if the flow area through metering passage 54 is too restrictive to allow the relief of fluid pressure within solenoid cavity 50 when poppet valve member 65 is moving from its closed position toward its open position. It has been found that the dynamic flow conditions produced by the opening of poppet valve member 65 (pressure spikes and expansion waves) can be substantially damped before reaching solenoid cavity 50 if the flow area through metering passage 54 is made relatively restrictive. Unfortunately, as stated earlier, if metering passage 54 is made too restrictive, undesirable secondary injections can also occur because of the inability to relieve fluid pressure from solenoid cavity 50. Thus, the minimum flow area through metering passage 54 must be large enough to relieve fluid pressure within solenoid cavity 50 in order to prevent secondary injections, but must also be sufficiently restrictive that pressure waves traveling through metering passage 54 are substantially damped before reaching solenoid cavity 50.

Referring now to the graphs shown in FIGS. 7–9, in injection mass flow, the differential pressure acting on the poppet valve member, poppet valve member position and solenoid status are graphed versus time for three differently sized metering passages 54. FIGS. 7*a–d* illustrate that a secondary injection can occur when metering passage 54 is made too small because of the inability to adequately relieve pressure from solenoid cavity 50. FIGS. 9*a–d* illustrate that a secondary injection can also occur when the metering passage 54 is made too large due to the inability of the metering passage to adequately damp pressure waves traveling up toward solenoid cavity 50. FIGS. 8*a–d* show that secondary injections can be avoided by making metering passage large enough to relieve pressure from solenoid cavity 50 but small enough to damp pressure waves traveling toward solenoid cavity 50.

Figure 5:
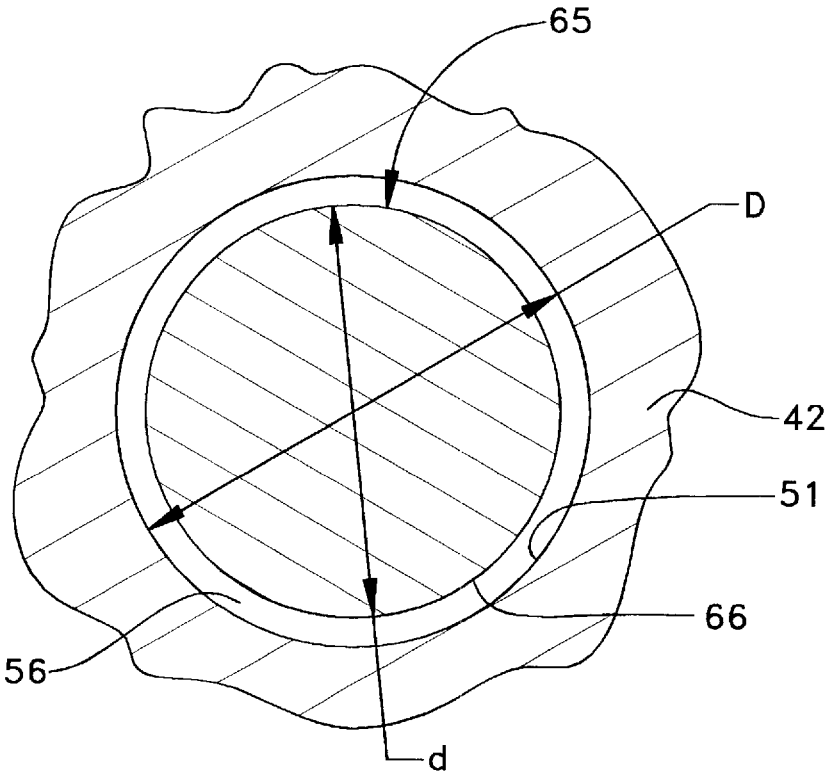
FIG. 5 is a top sectional view of a portion of a cartridge control valve as viewed along section line 5—5 of FIG. 3.

Referring now to FIG. 5, the minimum metering flow area (A) 56 through metering passage 54 of the embodiment shown in FIG. 3 is controlled by selecting an appropriate diametrical clearance (D-d) between a portion of portions 66 of poppet valve member 65 and an enlarged bore area 51 of guide bore 51. It should be noted that it is only in the diametrical clearance area 56 that guide bore 51 has a significantly larger inner diameter D than the outer diameter d of poppet valve member 65. The metering minimum flow area (A) occurs over a length L (see FIG. 3). In the remaining portion of guide bore 51, the inner diameter D of guide bore 51 is only slightly larger than the outer diameter d of poppet valve member 65 in a manner well known in the art. The optimum size and length of the diametrical clearance area 56 will vary somewhat from one cartridge valve to another due to such factors as the speed in which the poppet valve member moves, the magnitude of expected pressures generated within the fuel injector and other factors known in the art. A starting point in fine tuning an optimal metering clearance for a particular application should utilize the following formula: $D-d=0.185\ (L/D)$ mm. In all cases the outlet minimum flow area in the outlet passage will be large relative to the metering minimum flow area.

Figure 6:
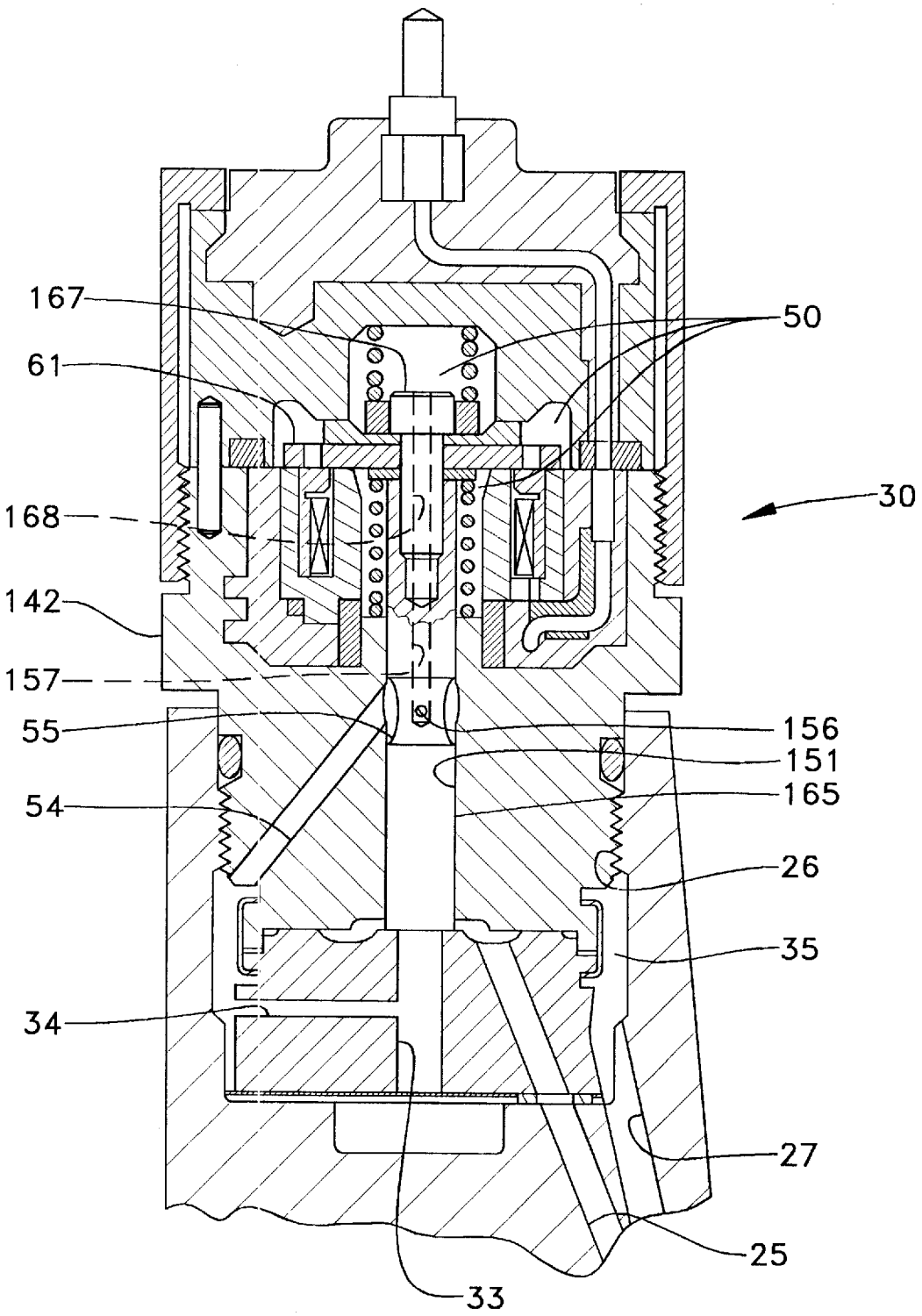
FIG. 6 is a partially sectioned side elevational view of a cartridge control valve according to another embodiment of the present invention.
Figure 9A:
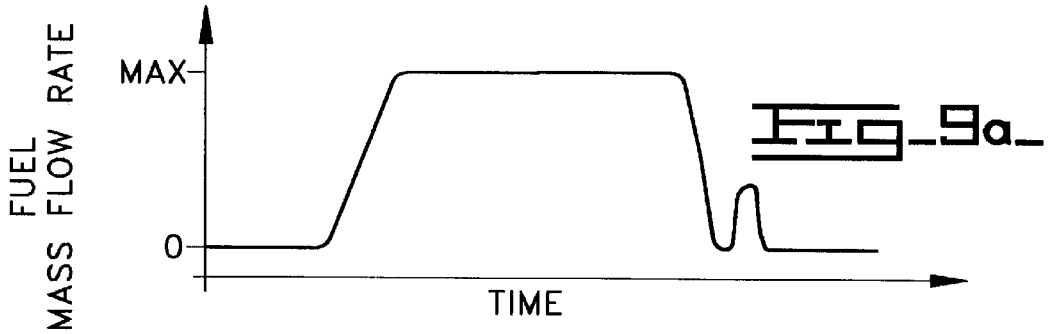
FIGS. 9*a–d* are graphs of fuel injection mass flow, poppet valve pressure differential, valve position and solenoid status, respectively, versus time for a single injection event when the metering passage is too large.
Figure 9B:
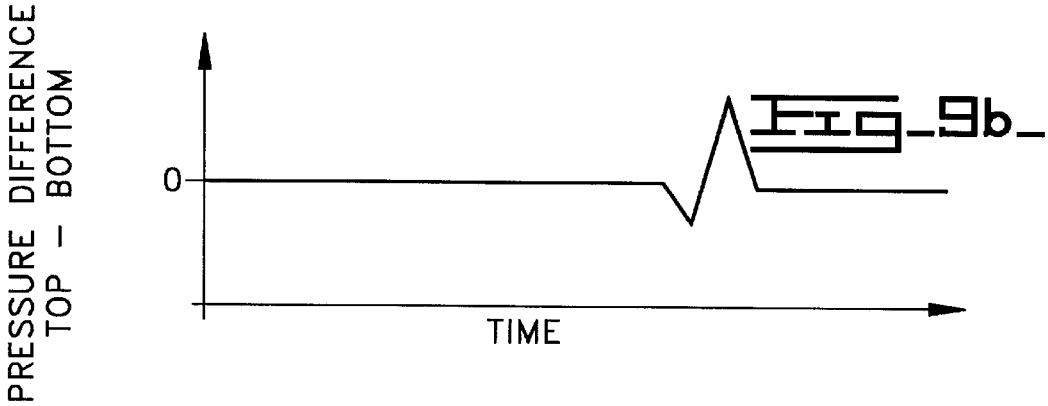
Figure 9C:
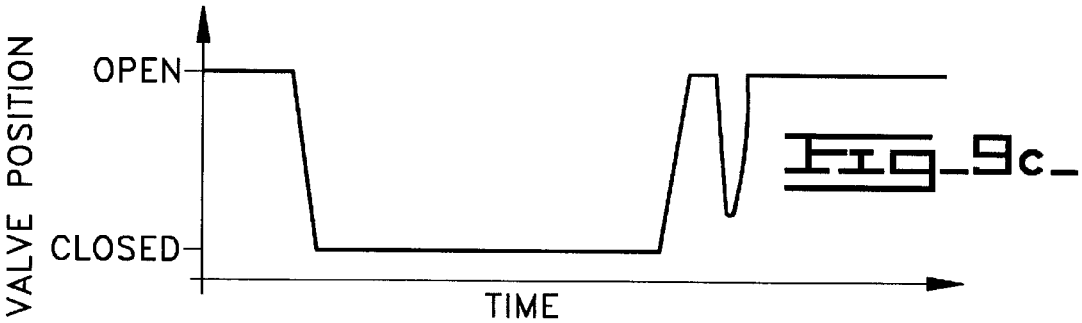
Figure 9D:
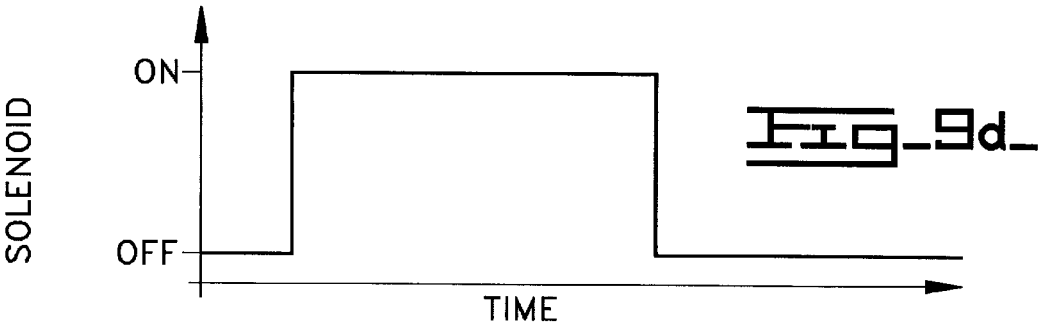

Referring now to FIG. 6, a cartridge control valve 130 according to another embodiment of the present invention is illustrated. Although most of the features of cartridge control valve 130 are identical to the cartridge control valve 30 illustrated earlier as shown by the use of some identical feature numbers, the metering minimum flow area in this embodiment is defined by a horizontal bore 156 through the poppet valve member 165 rather than by a diametrical clearance between the poppet valve member and a portion of its guide bore. In this embodiment, guide bore 151 made in valve body component 142 is substantially uniform in diameter and just slightly larger than the outer diameter of poppet valve member 65, in a manner known in the art. Poppet valve member 165 is modified to include a central bore 157 that opens to annulus 55 through restricted side passage 156. Central bore 157 communicates with solenoid cavity 50 via a central passage 168 extending the length of fastening screw 167. In this embodiment, the metering minimum flow area is defined by the diameter of restricted passage 156. As in the previous embodiment, the metering minimum flow area is preferably large enough to provide adequate pressure relief from solenoid cavity 50 into annular outlet passage 35, but sufficiently small that pressure waves traveling toward solenoid cavity 50 are substantially damped within passages 156, 157 and 168 of metering passage 54. Due to the part played by fuel viscosity in relation to the present invention, the metering minimum flow area can be somewhat dependent upon the combined length of passages 156, 157 and 168. In this embodiment, restricted passage 156 should have a diameter on the order of about 0.5 mm. Like the previous embodiment, the metering passage should be sufficiently large that the valve member is substantially prevented from bouncing toward its closed position after being moved to its open position due to adequate pressure relief in solenoid cavity 50, but be sufficiently small that a fluid pressure wave traveling toward solenoid cavity 50 through metering passage 54 is substantially damped before reaching the solenoid cavity 50.

INDUSTRIAL APPLICABILITY

The control valve of the present invention finds potential application in any case where a solenoid is mounted within a wetted cavity within a sealed valve body, and the valve is required to open and close a relatively high pressure inlet passage to a relatively low pressure outlet passage. The present invention is especially applicable to electronically controlled fuel injectors that rely upon a control valve to open and close a spill passage in order to control injection timing. The cartridge control valve of the present invention is particularly suited for mechanically actuated fuel injectors of the type manufactured by Caterpillar, Inc. of Peoria, Ill.

Although both of the embodiments of the present invention illustrated utilize a metering passage that is defined at least in part by a portion of the poppet valve member itself, the present invention also contemplates the possibility, if adequate space is available, that a separate metering passage connecting the solenoid cavity to the outlet passage of the valve is positioned away from the poppet valve member. In other words, there is no reason why the metering passage cannot be positioned virtually anywhere within the valve body provided that adequate space is available for the same. Those skilled in the art will appreciate that the optimum size of the metering passage according to the present invention can vary significantly due to a wide variety of parameters including but not limited to the size of the poppet valve member, the speed at which the poppet valve member moves between positions, the expected pressure gradients to be experienced within the valve body, the speed and distance over which a pressure wave generated at the valve seat must travel before reaching the solenoid cavity, and other factors known in the art. However, in almost all cases there should exist a range of sizes for the metering passage which will allow both for adequate pressure relief from the solenoid cavity and adequate damping of pressure waves traveling toward the solenoid cavity.

Thus, those skilled in the art will appreciate that numerous modifications and alternative embodiments of the present invention will be apparent in view of the foregoing description. Accordingly, this description is to be construed as illustrative only and is for the purpose of teaching those skilled in the art the best mode of carrying out the invention. The details of the structure may be varied substantially without imparting from the spirit of the invention, the scope of which is defined in terms of the claims as set forth below.

We claim:

1. A control valve comprising:

a valve body defining a solenoid cavity, an inlet passage, an outlet passage and a metering passage extending between said solenoid cavity and said outlet passage;

a solenoid mounted in said solenoid cavity;

a valve member with one end attached to said solenoid and positioned to reciprocate in said valve body between an open position in which said inlet passage is open to said outlet passage and a closed position in which inlet passage is closed to said outlet passage; and said inlet passage being in fluid communication with said solenoid cavity via said metering passage when said valve member is in said open position.

2. The control valve of claim 1 wherein said outlet passage has an outlet minimum flow area;

said metering passage has a metering minimum flow area; and said outlet minimum flow area is large relative to said metering minimum flow area.

3. The control valve of claim 2 wherein said metering passage includes a diametrical clearance between a bore defined by said valve body and a portion of said valve member;

said metering minimum flow area occurs over a length;

said bore has a diameter; and said diametrical clearance in millimeters is about equal to 0.185 times the ratio of said length to said diameter.

4. The control valve of claim 2 wherein said metering minimum flow area includes a restricted passage having a diameter of about 0.5 millimeters.

5. The control valve of claim 4 wherein a portion of said metering passage includes a diametrical clearance area between a bore defined by said valve body and a portion of said valve member.

6. The control valve of claim 5 wherein said valve member has a first hydraulic surface area exposed to fluid pressure in said solenoid cavity and a second hydraulic surface area exposed to fluid pressure in said outlet passage; and said first hydraulic surface area is about equal to said second hydraulic surface area.

7. The control valve of claim 5 wherein said outlet passage is separated from said inlet passage by a flat seating surface;

said valve member includes an annular knife edge; and said annular knife edge seats against said flat seating surface to close said outlet passage to said inlet passage when said valve member is in said closed position.

8. The control valve of claim 1 wherein a portion of said metering passage includes a diametrical clearance area between a bore defined by said valve body and a portion of said valve member.

9. The control valve of claim 8 wherein said metering minimum flow area occurs over a length;

said bore has a diameter; and said diametrical clearance in millimeters is about equal to 0.185 times the ratio of said length to said diameter.

10. The control valve of claim 1 wherein said metering passage includes a restricted passage having a diameter of about 0.5 millimeters.

11. The control valve of claim 1 wherein said metering passage being sufficiently large that said valve member is substantially prevented from bouncing toward said closed position after being moved to said open position; and said metering passage is sufficiently small that a fluid pressure spike traveling toward said solenoid cavity through said metering passage is substantially damped before reaching said solenoid cavity.

12. A control valve comprising:

a valve body defining a bore, a solenoid cavity, an inlet passage, an outlet passage and a metering passage extending between said solenoid cavity and said outlet passage;

a solenoid mounted in said solenoid cavity;

a valve member with one end attached to said solenoid and positioned to reciprocate in said valve body between an open position in which said inlet passage is open to said outlet passage and a closed position in which inlet passage is closed to said outlet passage;

said inlet passage being in fluid communication with said solenoid cavity via said metering passage when said valve member is in said open position;

a portion of said metering passage including a diametrical clearance area between said bore and a portion of said valve member;

said metering passage being sufficiently large that said valve member is substantially prevented from bouncing toward said closed position after being moved to said open position; and said metering passage is sufficiently small that a fluid pressure spike traveling toward said solenoid cavity through said metering passage is substantially damped before reaching said solenoid cavity.

13. The control valve of claim 12 wherein said metering passage includes a metering minimum flow area that occurs over a length;

said bore has a diameter;

said diametrical clearance area in millimeters is about equal to 0.15 times the ratio of said length to said diameter.

14. A fuel injector comprising:

an injector body defining a fuel inlet, a nozzle outlet and a cartridge opening, and further defining a spill passage and a return passage that open into said cartridge opening;

a cartridge control valve received in said cartridge opening and attached to said injector body;

said cartridge control valve including a valve body defining a solenoid cavity, an inlet passage that opens to said spill passage, an outlet passage that opens to said return passage, and a metering passage extending between said solenoid cavity and said outlet passage;

a solenoid mounted in said solenoid cavity;

a valve member with one end attached to said solenoid and positioned to reciprocate in said valve body between an open position in which said inlet passage is open to said outlet passage and a closed position in which said outlet passage is closed to said inlet passage; and said inlet passage being in fluid communication with said solenoid cavity via said metering passage when said valve member is in said open position.

15. The fuel injector of claim 14 wherein a portion of said metering passage includes a diametrical clearance area between a bore defined by said valve body and a portion of said valve member.

16. The control valve of claim 15 wherein said metering passage includes a metering minimum flow area that occurs over a length;

said bore has a diameter; and said diametrical clearance area in millimeters is about equal to 0.15 times the ratio of said length to said diameter.

17. The control valve of claim 14 wherein said outlet passage has an outlet minimum flow area;

said metering passage has a metering minimum flow area; and said outlet minimum flow area is large relative to said metering minimum flow area.

18. The fuel injector of claim 17 wherein said valve member has a first hydraulic surface area exposed to fluid pressure in said solenoid cavity and a second hydraulic surface area exposed to fluid pressure in said outlet passage; and said first hydraulic surface area is about equal to said second hydraulic surface area.

19. The fuel injector of claim 17 wherein said outlet passage is separated from said inlet passage by a flat seating surface;

said valve member includes an annular knife edge; and said annular knife edge seats against said flat seating surface to close said outlet passage to said inlet passage when said valve member is in said closed position.

20. The fuel injector of claim 14 wherein said metering passage is sufficiently large that said valve member is substantially prevented from bouncing toward said closed position after being moved to said open position; and said metering passage is sufficiently small that a fluid pressure spike traveling toward said solenoid cavity through said metering passage is substantially damped before reaching said solenoid cavity.

* * * * *